US006108824A

United States Patent [19]

Fournier et al.

[11] Patent Number: 6,108,824

[45] Date of Patent: Aug. 29, 2000

[54] HELMET ADJUSTMENT MECHANISM WITH QUICK RELEASE

[75] Inventors: Eric Fournier, Granby; T. Blaine Hoshizaki, LaSalle; Evangelos Spyrou, Montreal; Claude Prevost, St. Athanas, all of Canada

[73] Assignee: Sport Maska Inc., Quebec, Canada

[21] Appl. No.: 09/132,834

[22] Filed: Aug. 12, 1998

[51] Int. Cl.[7] ..... A42B 3/00

[52] U.S. Cl. ..... 2/418; 2/425

[58] Field of Search ..... 2/410, 411, 417, 2/418, 419, 420, 425, 421

[56] References Cited

U.S. PATENT DOCUMENTS

| | | | |
|---|---|---|---|
| Re. 34,699 | 8/1994 | Copeland et al. . | |
| 1,577,183 | 3/1926 | Dowiarz . | |
| 2,926,406 | 3/1960 | Edwards et al. . | |
| 3,204,251 | 9/1965 | Child | 2/420 |
| 3,447,163 | 6/1969 | Bothwell et al. . | |
| 3,629,864 | 12/1971 | Latina | 2/420 |
| 3,665,514 | 5/1972 | Durand | 2/420 |
| 4,404,690 | 9/1983 | Farquharson | 2/420 |
| 4,406,021 | 9/1983 | Bloom . | |
| 4,477,929 | 10/1984 | Mattsson . | |
| 4,539,715 | 9/1985 | Clement . | |
| 4,553,270 | 11/1985 | Hoffmann . | |
| 4,555,816 | 12/1985 | Broersma . | |
| 4,942,628 | 7/1990 | Freund . | |
| 4,999,846 | 3/1991 | Ball et al. . | |
| 5,077,836 | 1/1992 | Idoff et al. . | |
| 5,094,229 | 3/1992 | Pomatto et al. . | |
| 5,357,654 | 10/1994 | Hsing-Chi . | |
| 5,412,814 | 5/1995 | Pernicka et al. . | |

FOREIGN PATENT DOCUMENTS

| | | | |
|---|---|---|---|
| 1116801 | 1/1982 | Canada | 2/425 |

*Primary Examiner*—Michael A. Neas
*Attorney, Agent, or Firm*—Factor & Partners

[57] ABSTRACT

A helmet comprising a helmet front half section, helmet rear half section and a locking assembly. The helmet front half section includes at least one engagement region. The helmet rear half section includes at least one corresponding engagement region. The locking assembly a structure for orientating the locking assembly between a locked position and an unlocked position. In the locked position, the locking assembly results in secured engagement of the at least one engagement region of the front and rear helmet half sections with each other. The unlocked position facilitates slidable movement of the at least one engagement region of the front and rear helmet half sections and, in turn, the helmet half sections, relative to each other

16 Claims, 8 Drawing Sheets

HELMET ADJUSTMENT MECHANISM WITH QUICK RELEASE

BACKGROUND OF THE INVENTION

1. Field of the Invention

The present invention relates in general to helmets and, more particularly, to a mechanism for adjusting the size of helmets to, in turn, allow a wearer to quickly release and secure a proper helmet fit. Although adjustability is discussed specifically in relation to hockey helmets, it will be understood that the present device is not limited to use in association with hockey, or even sports.

2. Background Art

Adjustable helmets have been know in the art for years, and used in different applications such as sports, firefighting, construction work, and the military. In particular, many of these adjustable helmets allow the wearer to adjust the helmet size to fit a particular head. For example, helmet adjustability mechanisms have consisted of a stud and notch or a headband with a rack and pinion adjusting mechanism.

Although these and other conventional adjustability mechanisms have worked well, they have failed in a number of areas. For instance, many prior art designs do not allow the helmet wearer to adjust the size of the helmet while wearing the helmet. Accordingly, the helmet wearer must remove the helmet, adjust the helmet, and retry the helmet size multiple times before a proper fit can be established.

Moreover, many prior art designs do not allow a wearer to quickly and easily release the helmet from a locked position, quickly adjust the helmet size, and then quickly lock the helmet in a desired position. Many times, a screwdriver or other additional tool must be used to adjust the size of the helmet.

Additionally, in many prior art devices, adjustment occurs merely with respect to a headband lodged and secured inside of a helmet, not with respect to the size of the helmet shell itself. Consequently, a specific helmet size, though fitting a wearer because of a headband adjustment, is not appropriate for the wearer.

Finally, many prior art designs allow for adjustment only to certain predetermined sizes. As a result, a wearer with a head size in between two preset sizes is prevented from finding a comfortable and secure fit.

SUMMARY OF THE INVENTION

The invention comprises a helmet including a helmet front half section, a helmet rear half section and a locking assembly. The helmet front half section includes at least one helmet front half engagement region. The helmet rear half section includes at least one helmet rear half engagement region which corresponds to the at least one helmet front half engagement region. The locking assembly is associated with the engagement region of each of the front and rear helmet half sections. The locking assembly includes means for orientating the locked assembly between a locked position and an unlocked position. The locked position results in secured engagement of the at least one engagement region of the front and rear helmet half sections, with each other. The unlocked position facilitates slidable movement of the at least one engagement region of the front and rear helmet half sections, and, in turn, the helmet half sections themselves relative to each other.

In a preferred embodiment, the locking assembly includes a spring plate associated with an inner surface of the helmet rear half section, an outer attachment member and an extension member. The outer attachment member is associated with the outer surface of the helmet front half section. The extension member releasably joins the spring plate and the outer attachment member. The orientating means facilitates controlled relative movement of the spring plate and the outer attachment member to position the locking assembly in one of the locked and unlocked orientations.

In such a preferred embodiment, the helmet may further comprise at least one elongated slot and at least one opening. The at least one elongated slot is disposed on one of the helmet front half section and the helmet rear half section. The at least one opening is disposed on the other of the helmet front half section and helmet rear half section. The at least one opening corresponds to at least one elongated slot. The extension member extends from the spring plate through the at least one opening and the at least one elongated slot, to the outer attachment member.

In such a preferred embodiment, the orientation means comprises a rotatable attachment of the upper attachment member relative to the spring plate. Such a rotation of the upper attachment member relative to the spring plate facilitates the desired orientation of the locking assembly in one of a locked and unlocked orientation.

In another preferred embodiment, the orientation means comprises a slidable attachment of the upper attachment member relative to the spring plate. Slidable movement of the upper attachment member relative to the spring plate facilitates desired orientation of the locking assembly in one of a locked and unlocked orientation.

In yet another preferred embodiment, the locking assembly includes means for retaining the desired selected orientation. In such a preferred embodiment, the retaining means comprises means for biasing the extension member against the upper attachment member. This in turn prevents undesired inadvertent movement of the extension member and the upper attachment member.

Preferably, the helmet further includes means for shielding the locking assembly from inadvertent contact and inadvertent repositioning into an undesired position. In a preferred embodiment, the shielding means may comprise a slot capable of receiving at least a portion of the locking assembly.

In a preferred embodiment, the helmet front half section engagement region comprises a plurality of substantially symmetrical grooves and ridges. The helmet rear half section engagement region comprises at least one ridge. In such an embodiment, the helmet rear half section engagement region may further comprise a plurality of grooves and ridges. The grooves and ridges of each of the helmet rear half section engagement region and the helmet front half section engagement region are substantially uniform in size.

In another preferred embodiment, the orientating means may further include means for facilitating controlled adjustment of the helmet.

DETAILED DESCRIPTION OF THE INVENTION

Figure 1:
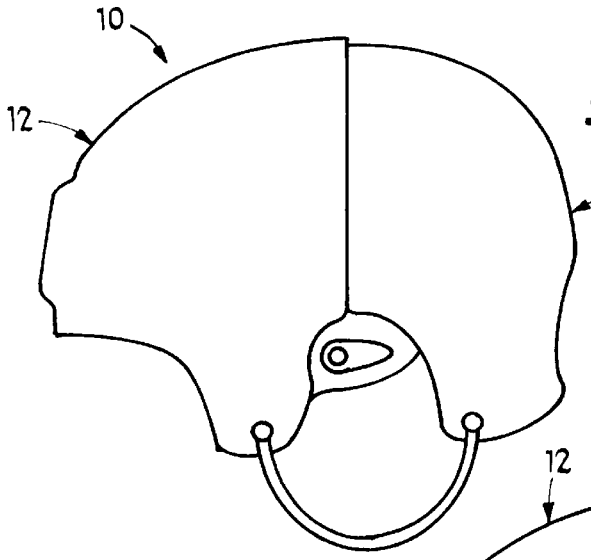
FIG. 1 of the drawings is a side elevational view of a helmet having a first embodiment of the helmet adjustment mechanism with quick release of the present invention.

While this invention is susceptible of embodiment in many different forms, there is shown in the drawings and will herein be described in detail, two embodiments with the understanding that the present disclosure should be considered as an exemplification of the principles of the invention and is not intended to limit the invention to the embodiments so illustrated.

Helmet 10 is shown in FIG. 1 as comprising helmet front half section 12 and helmet rear half section 14. Helmet front half section 12 and rear half section 14 are preferably comprised of a high strength plastic material and impact absorbing liner—although other conventional helmet constructions are likewise contemplated.

Figure 3:
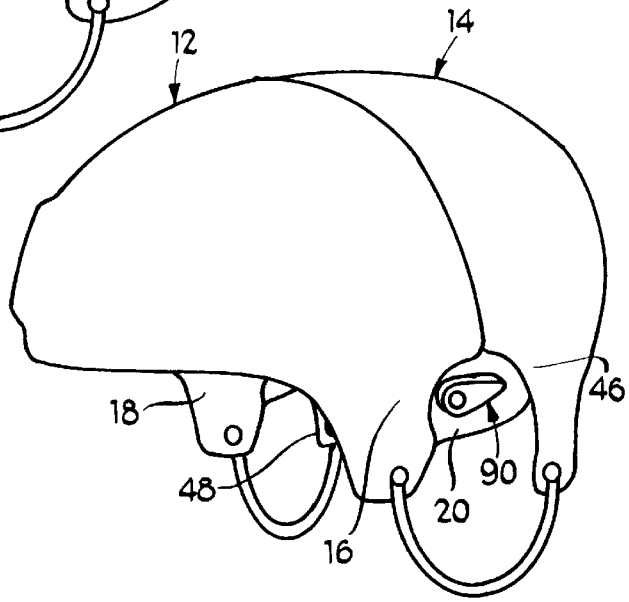
FIG. 3 of the drawings is a perspective view of a helmet having a first embodiment of the present invention.
Figure 13:
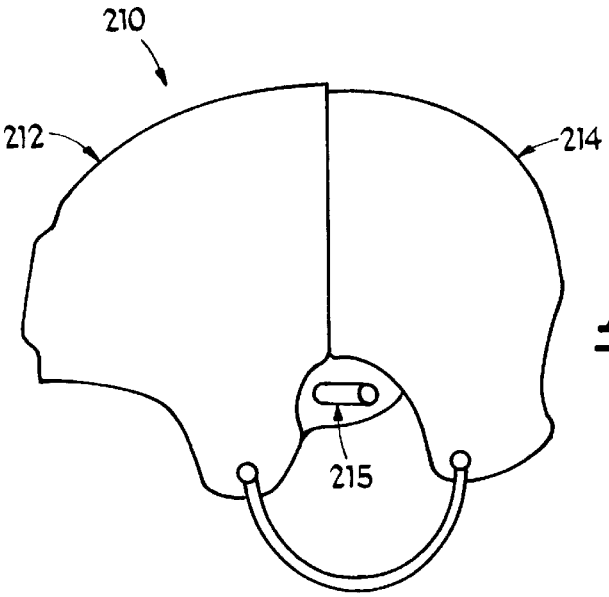
FIG. 13 of the drawings is a side elevational view of a helmet having the second embodiment of the helmet adjustment mechanism of the present invention.
Figure 2:
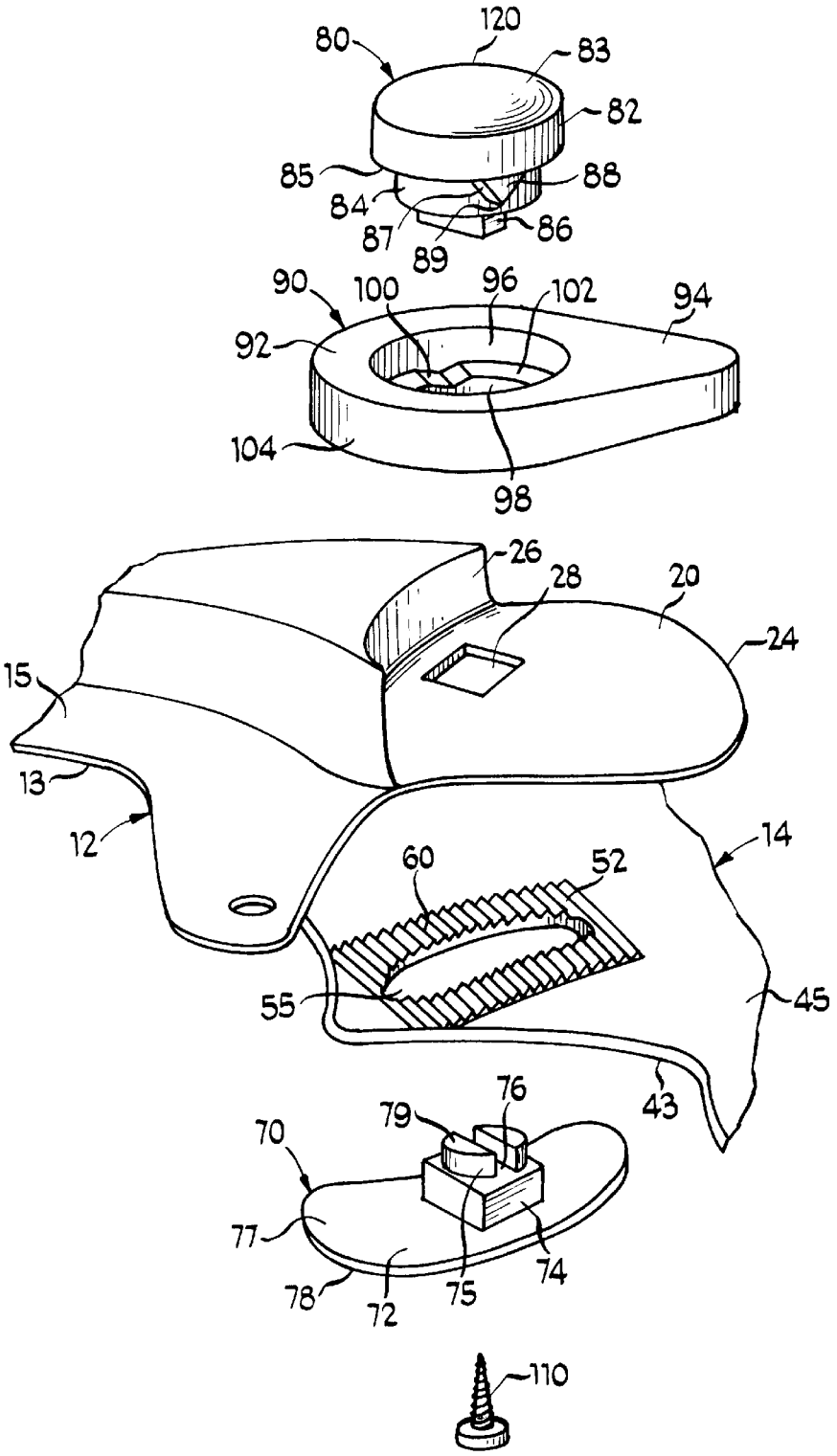
FIG. 2 of the drawings is an exploded view of the first embodiment of the present invention.

As shown in FIG. 2, helmet front half section 12 has inner surface 13, outer surface 15, and two side portions 16 and 18 (FIG. 3). Each of the side portions include an adjustment mechanism accepting region, such as accepting region 20. Inasmuch as the construction of both side portions are the same, reference will only be made to one of the side portions. Specifically, focusing on side portion 16, adjustment mechanism accepting region 20 comprises surface 24 and shoulder 26 (FIG. 2). As can be seen, surface 24 includes aperture 28. As will be explained, aperture 28 is intended to receive a portion of engagement member 74.

Shoulder 26 is shown in FIG. 2 as surrounding at least a portion of surface 24. Preferably, shoulder 26 emanates from, or is connected/associated with surface 24 by means of injection molding, an adhesive, or the like. Moreover, it is further contemplated that the surface is completely surrounded by shoulder 26. As can be seen, shoulder 26 is at least partially arcuate. Such a construction provides means for shielding the locking assembly from inadvertent undesired contact.

Figure 4:
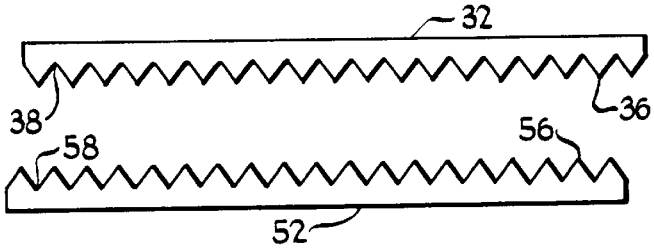
FIG. 4 of the drawings is a side elevational view of the engagement regions of the present invention.

Two engagement regions 32 and 34 are associated with the inner surface of helmet front half section side portions 16 and 18. Shown more specifically in FIGS. 2 and 4 (and as a representative description of both engagement regions), engagement region 32 comprises of a ratchet rack-like structure having a series of alternating ridges 36 and grooves 38 which surround at least a portion of aperture 28. Helmet rear half section 14, shown in FIG. 2, has an inner surface 43, an outer surface 45, and two side portions 46 and 48. Each side portion further comprises of an slot 55. In a preferred embodiment, slot 55 is in the form of a rectangular, oval, or elongated polygonal shape, although other configurations are also contemplated.

Each rear half section side portion 46 and 48 is shown in FIGS. 2 and 3 as having an engagement region 52 and 54, respectively, associated with outer surface 45. Shown more precisely in FIG. 4 (and as a representative description of both engagement regions), engagement region 52 has a structure substantially similar to that of engagement region 32 of the helmet front half section, with a series of alternating ridges 56 and grooves 58. As will be explained, engagement region 52 will cooperate with engagement region 32 (of the helmet front half) when adjusting the size of the helmet.

Furthermore in a preferred embodiment, ridges 56 and grooves 58 in helmet rear half section engagement regions 52 and 54 substantially correspond in many of their dimensions, including ridge height, groove depth, and ridge spacing to those ridges 36 and grooves 38 in helmet front half section engagement regions 32 and 34. While other configurations are contemplated, such a relationship provides an optimal mating relationship between the respective engagement regions.

The helmet front and rear half sections are releasably secured together, and, in turn, in a desired adjusted orientation, by a locking assembly (in combination with engagement regions, such as 32 and 54) as shown in FIG. 2. Locking assembly comprises spring plate 70, upper adjustment member 90 and means for orientating the locking assembly in one of a locked and unlocked orientation.

Spring plate 70 (shown in FIG. 2) comprises of flexible base 72, and engagement member 74. Flexible base 72 is preferably formed so as to impart both strength and flexibility thereto. In a preferred embodiment, flexible base 72 is substantially arcuate and has both a concave surface 77 and a convex surface 78. However, it is likewise contemplated that flexible base 72 may take the form of other configurations, including, but not limited to, a planar configuration with two extension regions extending from opposite ends of the planar portion as shown in the second embodiment.

Engagement member 74 is associated with concave surface 77 of spring plate 70, and includes spacer 81 and core knob 80. In a preferred embodiment, and as shown in FIG. 2, spacer 81 may comprise multiple components, with at least a bottom rectangular or square region, top circular spacer 75, and slot 76. In such an embodiment, core knob 80 is matingly associated with surface 79 of spacer 81 and attached via fastener 110. Of course, other attachment means are likewise contemplated, such as, glue, snap-fittings, and the like. However, engagement member 74 may also comprise a single, unitary construction having any number of configurations which enable operative cooperation between the spring plate and the upper adjustment member of the locking assembly.

Engagement member 74 is shown having a shape capable of passing through both helmet front half section apertures 28 and slot 55. Preferably, the shape of spacer 81 is substantially similar to that of helmet front half section aperture 28, so as to allow substantial abutment of spacer 81 with an inside surface of aperture 28. Such a configuration provides for effective cooperation between engagement member 74 and aperture 28. Furthermore, the height of spacer 81 preferably exceeds the thickness of helmet front half and rear half side regions 16, 46, respectively—the thickness measured in an area immediately surrounding apertures 28 and 55 when front half 12 and rear half 14 sections are placed in overlapping and mating abutment.

Core knob 80, shown in FIG. 2, is attached to engagement member 74 and, in turn, spring plate 70. Core knob 80 comprises top knob component 82, step 84, finger 86, and guide 88. Top knob component 82 has both a top surface 83 and a bottom surface 85, and is generally circular in shape. Step 84 is adjacent bottom surface 85 of top knob component 82, and is also generally circular in shape. In a preferred embodiment, top knob component 82 and step 84 take the form of substantially concentric circles, with top knob component 82 having a diameter larger than that of step 84.

Furthermore, guide 88 is also attached to bottom surface 85 of top knob component 82. Guide 88 is preferably triangular shaped, so as to have angled sides 87 culminating in a point 89 or a planed surface (not shown). However, other configurations allowing the sides of the guide to have at least some degree of slope are also contemplated. In a preferred embodiment, two similarly shaped guides are attached to the top knob component at opposite points on the top knob component bottom surface perimeter.

Referring still to FIG. 2, finger 86 comprises of a block with substantially the same shape and size as slot 76 in spacer 81. Accordingly, when inserted into slot 76, finger 86 lies in substantial abutment with the inside and bottom surfaces of the slot to create a secure fit.

Upper adjustment member 90 is shown in FIG. 2 as comprising cavity region 92 and handle region 94. Cavity region 92, which operatively accepts a portion of core knob 80, further includes a substantially circular aperture 96 and a shelf 98. Circular aperture 96 has a diameter larger than the radius of top knob component 82 so as to allow the top knob component to fit inside circular aperture 96. Shelf 98 (positioned on the interior portion of the rotational knob) surrounds aperture 95 having an inside diameter smaller than the diameter of circular aperture 96. In a preferred embodiment, the diameter of aperture 95 is larger than the diameter of step 84 of core knob 80, so as to facilitate insertion of step 84 into aperture 95.

Preferably, apertures 96 and 95 have diameters only slightly larger than the diameters of top knob component 82 and step 84, respectively, so as to create a secure, abutting fit—while enabling substantially free rotation of core knob 80 in circular aperture 96.

Furthermore, shelf 98 also comprises of at least one notch 100 in shelf top surface 102. Notch 100 has a shape substantially corresponding to the shape of guide 88 on core knob 80, so as to allow a proper fit of the guide into the notch. In one embodiment, there are two notches 100 in shelf top surface 102, preferably at opposite points on the top shelf surface perimeter, both corresponding to and aligned with guides 88.

Cavity region 92 further has an outside surface 104 with a shape that is generally arcuate. This orientation allows cavity region 92 to effectively cooperate with shoulder 26 of the helmet front half section accepting region when rotated about a longitudinal axis 120.

While other configurations are contemplated, handle region 94 extends such that upon turning of the handle in either a clockwise or counterclockwise direction, the handle region, in combination with shoulder 26, prevents a full 360° rotation of upper attachment member 90.

With respect to assembly of the invention, helmet rear half section 14 telescopes into helmet front half section 12—although those with ordinary skill in the art will recognize that the present invention may easily be designed with the reverse construction in mind. Upon telescoping and thus overlapping, engagement regions 52 and 54 on the outer face of helmet rear half section 14 come into contact and mate with engagement regions 32 and 34 on the inner face of helmet front half section 12. In a mating position, ridges 36 and grooves 38 from helmet front half section engagement regions 32 and 34 fit into the corresponding grooves 58 and ridges 56 of helmet rear half section engagement regions 52 and 54.

The locking assembly is then utilized to secure the two helmet half sections together. As is shown in FIG. 2, spacer 74 on spring plate 70 is inserted through aperture 55 in the helmet rear half section 14, and then through the corresponding aperture 28 in the helmet front half section 12. When fully inserted, concave surface 77 of flexible plate 72 is positioned such that it is in contact with the inner surface 43 of the helmet rear half section. Notably, before pressure or tension is applied, only the concave ends of flexible plate 72 are in contact with inner surface 43.

Upper attachment member 90 is subsequently positioned such that top circular spacer component 75, with slot 76, extends into aperture 96. Assembled, outside arcuate surface 104 on cavity region 92 substantially abuts shoulder 26 so as to allow rotation of the upper attachment member 90 about longitudinal axis 120 extending through the middle of aperture 96. Core knob 80 of the engagement member is then inserted into the top of aperture 96 such that: finger 86 fits into spacer slot 76; step 84 fits into shelf aperture 95; top knob component 82 rests on shelf 98; and, guides 88 fit into notches 100. Screw 110 (or alternative fastening means) is then used to attach spring plate 70 to core knob 80, wherein the attachment actually sandwiches, and, in turn, releasably secures rotational upper attachment member 90, helmet front half section 12, and helmet rear half section 14 therebetween.

In useable operation, the locking assembly includes means for orientating the locking assembly in one of essentially two orientations: an adjusting/unlocked orientation and a locking orientation. In the adjusting/unlocked orientation, the upper adjustment member is rotated such that guides 88 of core knob 80 are positioned within notches 100. Indeed, in this orientation, the locking assembly is in a state of minimal tension, and the force holding the two helmet sections 12 and 14 is at a minimum. Accordingly, in such an orientation, helmet size may be adjusted by sliding engagement regions 52 and 54 of the helmet rear half section over engagement regions 32 and 34 of the helmet front half section. The elongated shape of slot 55 (FIG. 2) allows helmet rear half section 14 to be moved fore and aft relative to spring plate assembly 70 and helmet front half section 12. Such adjustment can be accomplished while a user is actually wearing the helmet or, if desired, while the helmet is removed from the wearer's head.

Figure 5:
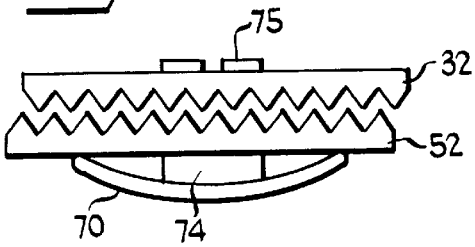
FIG. 5 of the drawings is a side elevational view of the first embodiment invention showing, in particular the locking assembly in the unlocked orientation.

Inasmuch as the ends of flexible base 72 are in contact with inner surface 43 of helmet rear half section 14, at least a portion of the teeth from both front 32 and 34 and rear 52 and 54 helmet half section engagement regions, respectively, remain in a slidable relationship (with some contact therebetween) with each other (see FIG. 5). Accordingly, such a relationship allows the helmet user/wearer to maintain a tactile feel as the teeth are slid over one another during helmet adjustment. Thus, the end result is a mechanism that allows for adjustment of the helmet with more controllable movements and, in turn, greater accuracy toward a desired fit.

Figure 6:
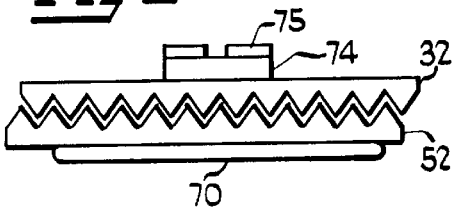
FIG. 6 of the drawings is a side elevational view of the first embodiment invention showing, in particular the locking assembly in the locked orientation.

Once the wearer has adjusted the helmet to the correct size, upper adjustment member 90 is then rotated into the locking orientation. Indeed, upon turning of the upper adjustment member, guides 88 of the core knob slide out of shelf notches 100 and, in turn, into contact with a portion of shelf top surface 102. When this occurs, spring plate 70 and upper attachment member 90 are forced toward each other which, in turn, securely compresses helmet halves 12 and 14 and their respective engagement regions into a locked and secured adjusted orientation (see FIG. 6). As can be seen, the locked orientation secures the helmet halves together not only by the "locked" cooperation between the teeth of the respective engagement regions, but also by the sheer compressive force placed on the two helmet half sections by the locking orientation of the locking assembly. In addition, the convex surface configuration further adds a biasing force onto the engagement regions to further maintain the engagement of same.

In an alternate embodiment, as shown in FIGS. 7–13, helmet 210 includes locking assembly 215 which includes spring plate 270, upper adjustment member 280 and cover 290. As will be explained, locking assembly 215 is likewise positioned on either side of helmet 210 and serves to lock and maintain the relative positioning of the front and rear half sections 212 and 214.

In such an embodiment, and as will be explained, accepting region 220 of helmet front half section 21 2 includes two apertures positioned at a distance equal to the relative distance between post members 272, 274 of spring plate 270. In addition, helmet rear half section includes two corresponding slots 255, 255' which substantially correspond in length to the desired range of movement of the helmet half sections.

Figure 7:
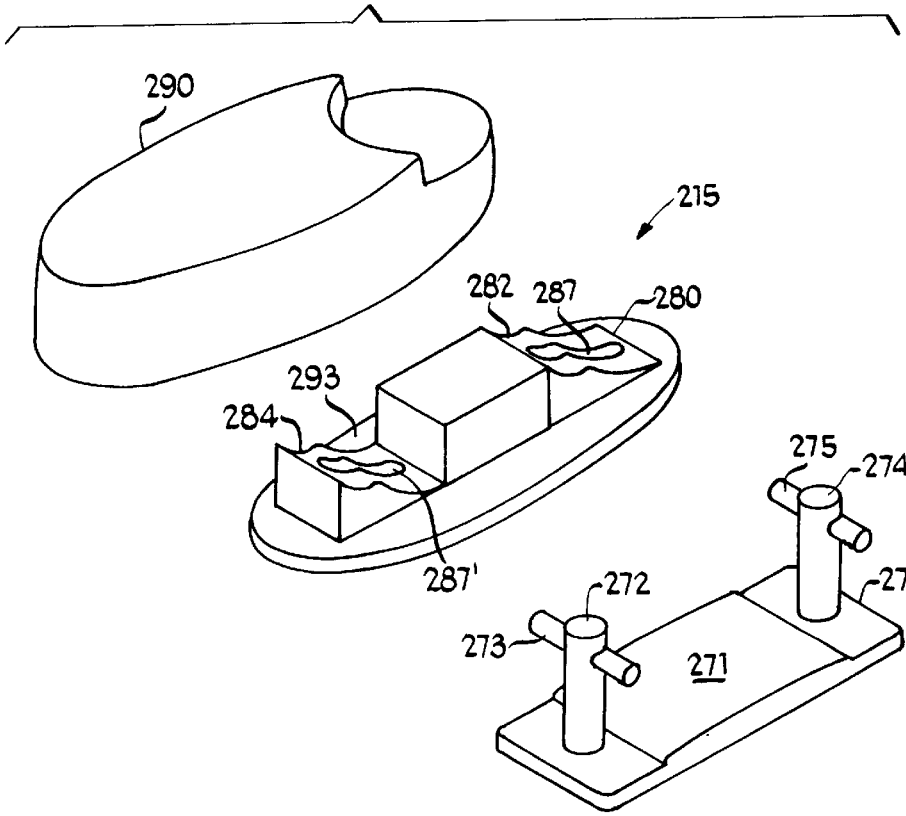
FIG. 7 of the drawings is an exploded view of a second embodiment of the locking assembly of the present invention.
Figure 10:
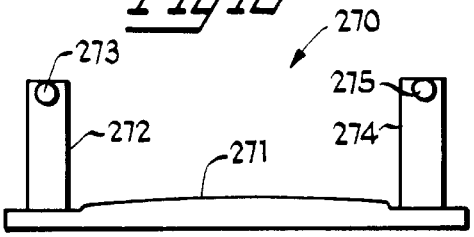
FIG. 10 of the drawings is a side elevational view of the spring plate of the second embodiment of the present invention.
Figure 11:
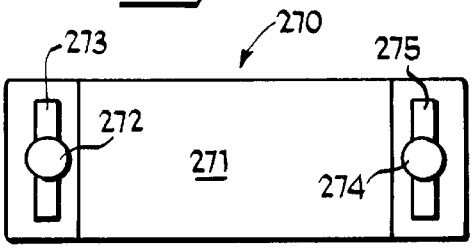
FIG. 11 of the drawings is a top plan view of the spring plate of the second embodiment of the present invention.

Spring plate 270 is shown in FIGS. 7, 10 and 11 as including base 271 and engagement members 291. Base 271 likewise includes a concave surface which provides a means for biasing the extension regions into operative engagement. Engagement member 291 includes post members 272, 274, cross members 273, 275. Post members 272, 274 emanate upwardly from base members. Cross members 273 are substantially perpendicular to the respective post member and positioned parallel to and a predetermined distance away from base member 271.

Figure 12:
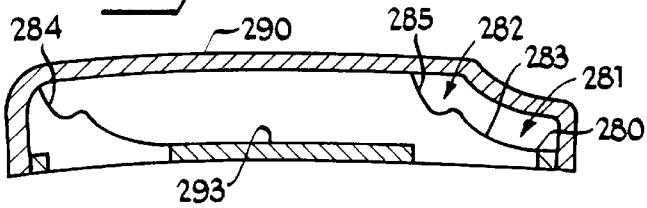
FIG. 12 of the drawings is a side elevational view of the upper plate and cover of the second embodiment of the present invention.

Upper adjustment member 280 is shown in FIGS. 7 and 12 as including base 293, first retention region 282 and second retention region 284. First retention region 282 includes opening 287 (FIG. 7), release region 281 (FIG. 12), transition region 283 (FIG. 12), and locking region 285 (FIG. 12). Transition region 283 is substantially continuous and is ramp like, providing for a continuous path from the release region to the locking region. Locking region 285 includes retention protrusion 286 which serves to retain the upper adjustment members in the locked orientation.

Second retention region 284 is spaced apart from first retention region 282 a distance substantially equal to the spacing of post members 272 and 274. It will be understood that second retention region 284 is substantially identical to first retention region in size, orientation and function.

Cover member 290, as shown in FIG. 7, is substantially dimensioned to coincide with that of upper plate 280 and includes a cavity of sufficient size so as to fully cover and contain the first and second locking regions 282, 284 of upper plate 280. While other methods of attachment are contemplated, such as adhesive or fasteners, cover member 290 attaches to upper plate 280 through a press-fit/snap-fit attachment.

The assembly of the second embodiment is as follows. Similar to the first embodiment, rear half section 214 telescopes into helmet front half section 212. Of course, as with the first embodiment, helmet front half section 212 can be configured to telescope into helmet rear half section 214. Once telescoped, engagement region 252 (FIGS. 8 and 9) on the outer face of helmet rear half section 214 matingly engages with engagement region 232 which is positioned on the inner face of helmet front half section 12. Similarly, it is contemplated that an identical structure may be positioned on the opposite side of the helmet.

Once the two helmet half sections are mated, locking assembly 215 is used to retain the locked position. In particular, spring plate 270 is positioned so that base 271 is positioned against the inner surface of the helmet rear half section 214 and so that the posts 272 and 274 extend through aperture 255, 256 of helmet rear half section 214 and through corresponding apertures 228, 229 of helmet front half section 214, respectively.

Once spring plate 270 is positioned to interface with the helmet half portions, upper plate 280 is positioned so that the lower surface of the upper plate abuts the outer surface of helmet front half section 12, and so that the posts extend through openings 287, 287'. Once in the desired position, the cross members will be retained in the release regions of the respective retaining region. Once the spring plate and the upper plate are assembled, cover member 290 is snapped to the upper plate, and, in turn, retained thereby.

Due to the elongated nature of the openings 287, 287', the upper plate can slide relative to the lower plate so that the cross-members can travel across openings 287, 287' from the respective release region to the locking region thereof. As will be explained, as the user moves upper plate 290 relative to spring plate 270, cross members 273, 274 are directed from the respective release region to the locking region. As the cross members move, due to the ramp-like configuration of the transition region, the spring plate and the upper attachment member force the engagement regions of the front and rear half sections into engagement, and, in turn, a locked orientation.

Figure 8:
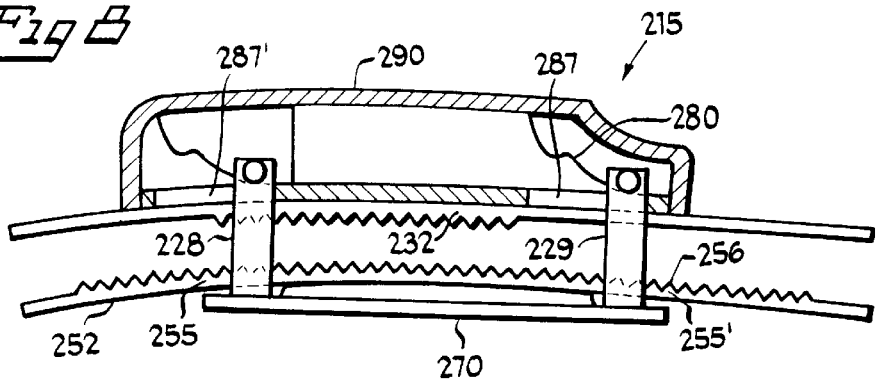
FIG. 8 of the drawings is a side elevational view of the second embodiment of the invention, showing in particular, the locking assembly in the unlocked orientation.
Figure 9:
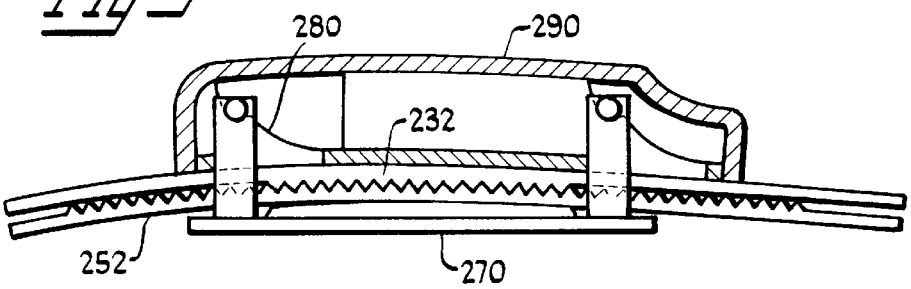
FIG. 9 of the drawings is a side elevational view of the second embodiment of the invention, showing in particular the locking assembly in the locked orientation.

In operation, much like the first embodiment, locking assembly has two orientations, an adjusting (or unlocked) orientation and a locking orientation, as well as, means for orientating the locking assembly into one of the foregoing orientations. In the adjusting (unlocked) orientation, the spring plate is slid relative to the upper plate so that each cross member is positioned in the respective release region of the first and second locking members. Such an orientation, as shown in FIG. 8, disengages the engagement regions which renders the helmet front half section from the helmet rear half section. As with the first embodiment, the second embodiment, in the unlocked orientation may nevertheless retain contact with the respective engagement regions so as to maintain a tactile feel as the respective teeth of the engagement regions are slid relative to each other.

The user next adjusts the helmet by sliding engagement regions 152 and 154 of the helmet rear half section over engagement regions 232 and 234 of helmet front half section. The elongated shape of slot 255 allows helmet rear half section to be moved fore and aft relative to the spring plate and helmet front half section.

Once the correct desired size has been determined, the upper plate is slid relative to the spring plate so that the cross members 273, 275 are slid from the respective release region, through the respective transition region, to the respective locking region of the first and second retaining region 282, 284. Once in the locked region, as explained above, the respective engagement regions matingly engage and the helmet is, in turn, in the locked orientation. Just as with the first embodiment, the helmet regions are "locked" together through cooperation of the teeth of the engagement regions and by the shear compressive force placed by the cooperation between the spring plate and the upper plate. Moreover, the retention protrusion 286 further facilitates retention of the locking assembly in the locked orientation.

An alternate construction of the above-described second embodiment is shown in FIGS. 14–28 (where structures shown in the second embodiment correspond to structures in the below-described embodiment, common reference numerals will be utilized). In such an embodiment, as shown in FIGS. 14–20, the top portion of helmet front half section 312 telescopes into the top portion of helmet rear half section 314. However, the side portions of helmet rear half section 314 telescope into each of side portions 316, 318 of helmet front half section 312, respectively.

Figure 14:
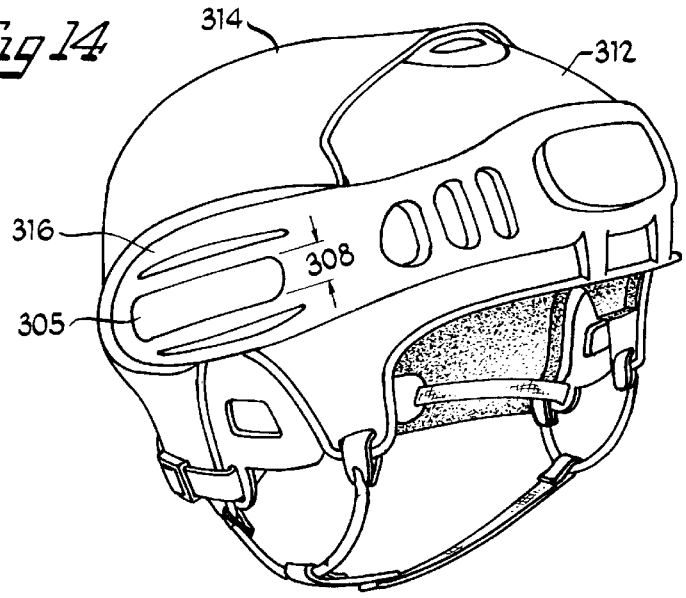
FIG. 14 of the drawings is a perspective view of a helmet having a third embodiment of the helmet adjustment mechanism of the present invention.
Figure 15:
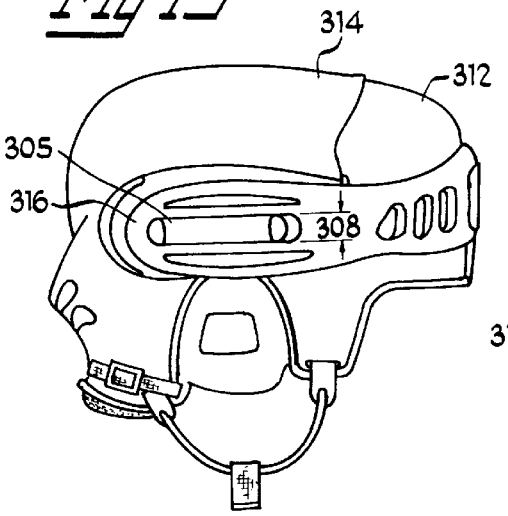
FIG. 15 of the drawings is a right side elevational view of the helmet having the third embodiment of the helmet adjustment mechanism of the present invention.
Figure 16:
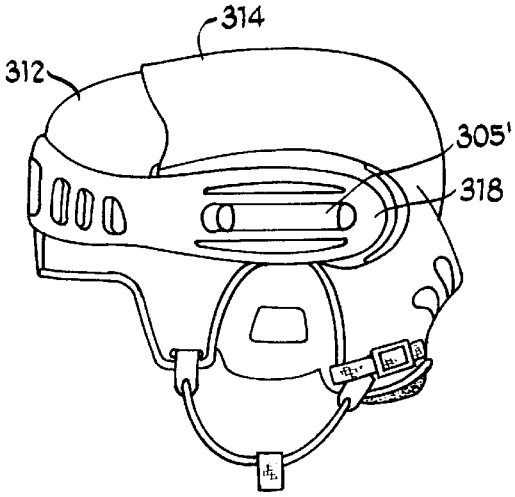
FIG. 16 of the drawings is a left side elevational view of the helmet having the third embodiment of the helmet adjustment mechanism of the present invention.
Figure 17:
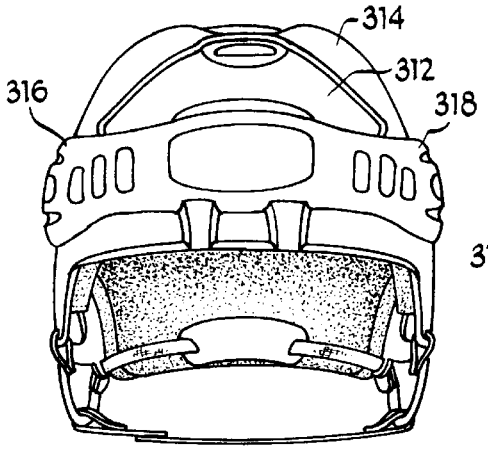
FIG. 17 of the drawings is a front elevational view of the helmet having the third embodiment of the helmet adjustment mechanism of the present invention.
Figure 18:
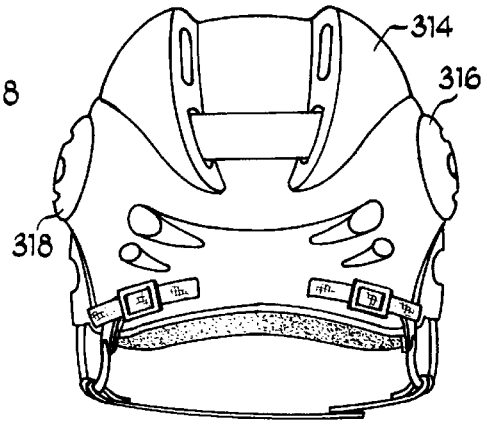
FIG. 18 of the drawings is a rear elevational view of the helmet having the third embodiment of the helmet adjustment mechanism of the present invention.
Figure 19:
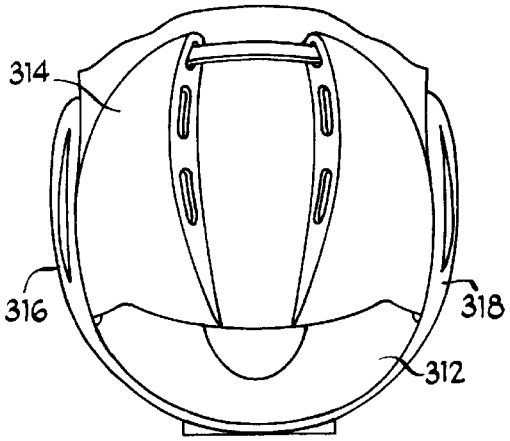
FIG. 19 of the drawings is a top plan view of the helmet having the third embodiment of the helmet adjustment mechanism of the present invention.
Figure 20:
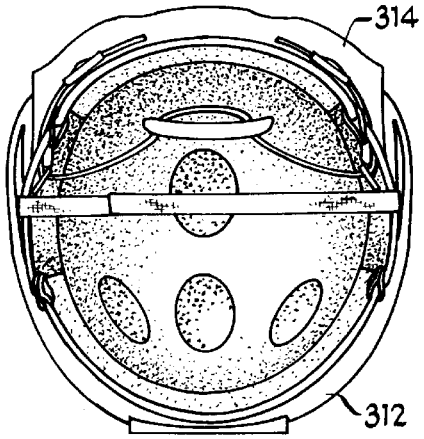
FIG. 20 of the drawings is a bottom plan view of the helmet having the third embodiment of the helmet adjustment mechanism of the present invention.

As shown in FIGS. 14–16, side portion 316 includes elongated slot 305 (FIG. 14, 15), and side portion 318 includes elongated slot 305' (FIG. 16). Inasmuch as slot 305 and slot 305' are substantially identical, only slot 305 will be described.

Figure 21:
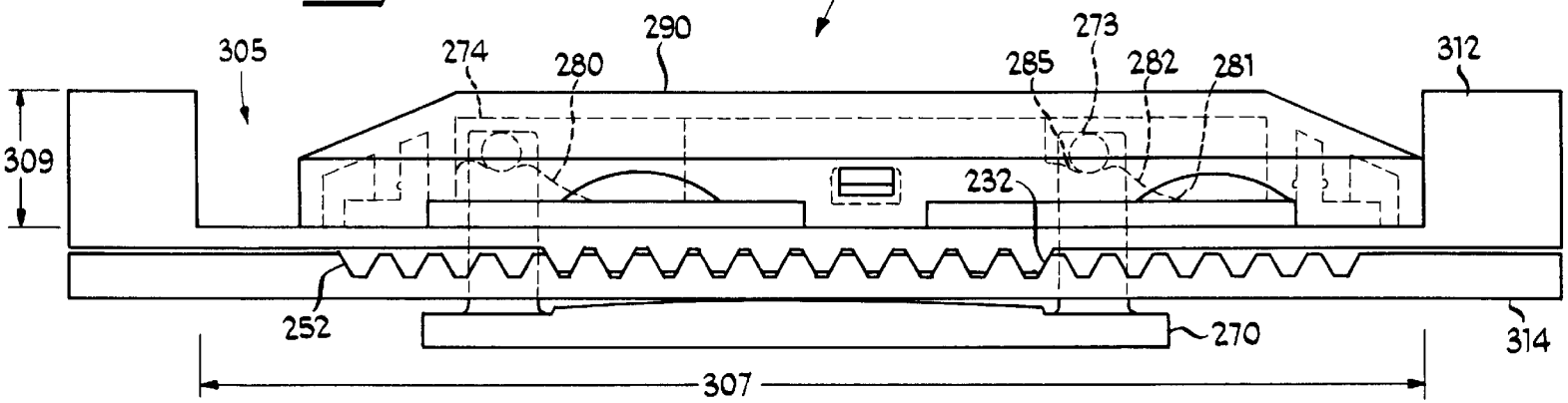
FIG. 21 of the drawings is a cross-sectional view of the third embodiment of the helmet adjustment mechanism of the present invention, showing, in particular, the locking assembly in the locked orientation.
Figure 22:
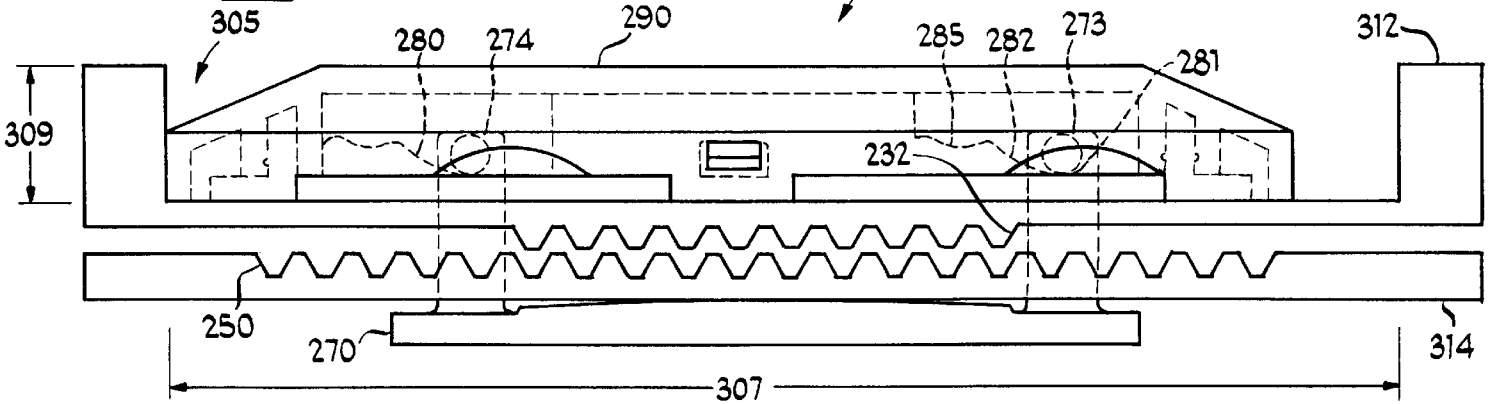
FIG. 22 of the drawings is a cross-sectional view of the third embodiment of the helmet adjustment mechanism of the present invention, showing, in particular, the locking assembly in the unlocked orientation.
Figure 23:
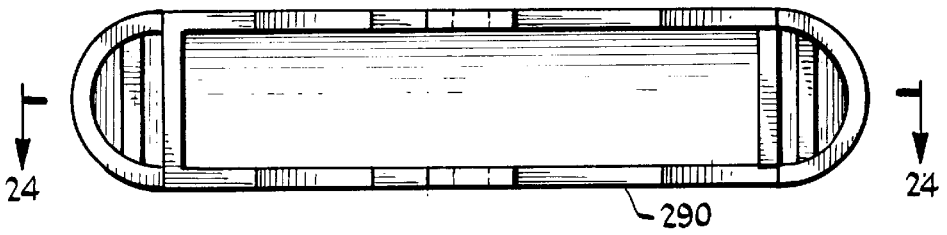
FIG. 23 of the drawings is a bottom plan view of the cover member of the third embodiment of the helmet adjustment mechanism of the present invention.
Figure 24:
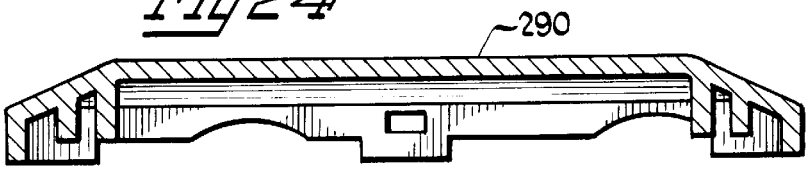
FIG. 24 of the drawings is a cross-sectional view of the cover member of the third embodiment of the helmet adjustment mechanism of the present invention, taken generally about lines 24—24 of FIG. 23.
Figure 25:
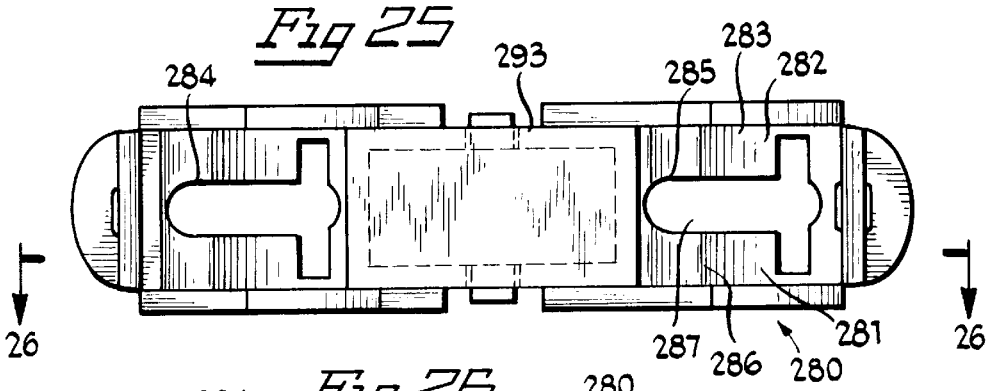
FIG. 25 of the drawings is a top plan view of the upper adjustment member of the third embodiment of the helmet adjustment mechanism of the present invention.
Figure 26:
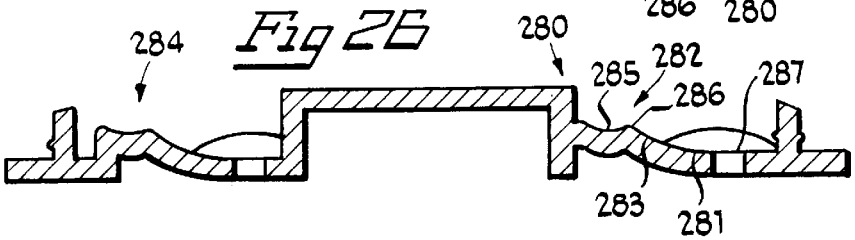
FIG. 26 of the drawings is a cross-sectional view of the upper adjustment member of the third embodiment of the helmet adjustment mechanism of the present invention, taken generally about lines 26—26 of FIG. 25.
Figure 27:
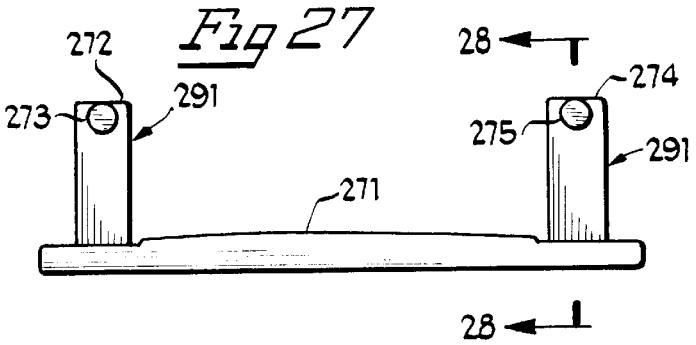
FIG. 27 of the drawings is a side elevational view of the spring plate of the third embodiment of the helmet adjustment mechanism of the present invention.
Figure 28:
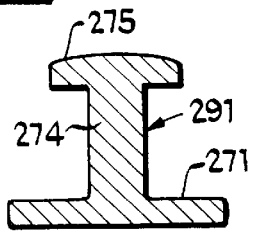
FIG. 28 of the drawings is a cross-sectional view of the spring plate of the third embodiment of the present invention, taken generally about lines 28—28 of FIG. 27.

As can be seen, slot 305 includes length 307 (FIGS. 21 and 22), width 308 (FIGS. 14 and 15) and depth 309 (FIGS. 21 and 22). As shown in FIGS. 21 and 22, slot 305 is configured to facilitate both acceptance of upper plate 280 and cover member 290, and longitudinal slidable movement of the upper plate/cover member to orientate the locking assembly from the locked to the unlocked orientation, and, likewise, from the unlocked orientation back to the locked orientation. (A detailed view of upper plate 280 and cover member 290 in this preferred alternative embodiment can be seen in FIGS. 21–26). In addition, due to depth 309 of slot 305, cover member 290 is substantially recessed within the slot region and substantially flush with the helmet front half section surrounding slot 305.

In operation, as shown in FIGS. 21 and 22, the user can freely slide upper plate 280 relative to spring plate 270 to release the helmet front half section from the helmet rear half section. In particular, cross members 273, 274 of spring plate 270 pass from the respective locked region, such as locked region 285 of first retention region 282 of upper plate 280, to the respective release region, such as release region 281. (A detailed view of spring plate 270 in this preferred alternative embodiment can be seen in FIGS. 21–22 and 27–28). Once in the release region, the user can freely adjust the helmet front half section 312 relative to helmet rear half section 314, to, in turn, adjust the size of the helmet to more properly fit the user's head.

Next, once adjusted as desired, the user can again slide upper plate 280 relative to spring plate 270 so as to again lock the helmet front half section to the helmet rear half section. In particular, such movement returns cross members 273, 274 to the respective locked regions of the upper plate 280. Once locked, the user can again utilize the helmet.

Such a positioning of the upper plate within the slot likewise provides a means for shielding the upper plate and the cover member from inadvertent and undesired unlocking of upper plate 280 relative to spring plate 270. Thus, due to such a structure, the upper plate and the cover member are essentially shielded and, in turn, substantially precluded from slidably moving or otherwise reorientating, if, for example, any contact takes place between the helmet and, where the helmet is used for playing hockey, a puck, a stick, other players, the ice or the boards.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A helmet, comprising:

a helmet front half section including at least one helmet front half engagement region;

a helmet rear half section including at least one helmet rear half engagement region corresponding to the at least one helmet front half engagement region; and a locking assembly associated with the engagement region of each of the front and rear helmet half sections, the locking assembly including means for orientating the lock assembly between a locked position and an unlocked position, wherein the locked position results in secured engagement of the at least one engagement region of the front and rear helmet half sections with each other, and the unlocked position facilitates slidable movement of the at least one engagement region of the front and rear helmet half sections and, in turn, the helmet half sections, relative to each other, and the locking assembly including means for biasing the at least one helmet rear half engagement region with the at least one helmet front half engagement region to facilitate the maintenance of the secured engagement.

2. The helmet according to claim 1 wherein the biasing means comprises a spring plate associated with an inner surface of the helmet rear half section, and the locking assembly includes an outer attachment member associated with an outer surface of the helmet front half section, and an extension member releasably joining the spring plate and the outer attachment member, the orientating means facilitating controlled relative movement of the spring plate and the outer attachment member, to position the locking assembly in one of the locked and unlocked orientations.

3. The helmet according to claim 2 further comprising:

at least one elongated slot disposed on one of the helmet front half section and the helmet rear half section, at least one opening disposed on the other of the helmet front half section and the helmet rear half section, the at least one opening corresponding to the at least one elongated slot, wherein the extension member extending from the spring plate through the at least one opening and the at least one elongated slot to the outer attachment member.

4. The helmet according to claim 3 wherein the orientation means comprises a rotatable attachment of the outer attachment member relative to the spring plate, wherein such rotation of the outer attachment member relative to the spring plate facilitates the desired orientation of the locking assembly in one of a locked and an unlocked orientation.

5. The helmet according to claim 3 wherein the orientation means comprises a slidable attachment of the outer attachment member relative to the spring plate, wherein slidable movement of the outer attachment member relative to the spring plate facilitates a desired orientation of the locking assembly in one of a locked and an unlocked orientation.

6. The helmet according to claim 1 further including means for shielding the locking assembly from inadvertent contact, and, in turn, inadvertent repositioning into an undesired position.

7. The helmet according to claim 6 wherein the shielding means comprises a slot region sized to accept at least a portion of the locking assembly, to, in turn, prevent inadvertent repositioning into an undesired position.

8. The helmet according to claim 1 wherein the helmet front half section engagement region comprises a plurality of substantially symmetrical grooves and ridges, and the helmet rear half section engagement region comprises at least one ridge.

9. The helmet according to claim 8 wherein the helmet rear half section engagement region comprises a plurality of grooves and ridges, the grooves and ridges of each of the helmet rear half section engagement region and the helmet front half section engagement region being substantially uniform in size.

10. The helmet according to claim 1 wherein the orientating means further includes means for facilitating controlled adjustment of the helmet.

11. A helmet, comprising:

a helmet front half section including at least one helmet front half engagement region;

a helmet rear half section including at least one helmet rear half engagement region corresponding to the at least one helmet front half engagement region; and a locking assembly associated with the engagement region of each of the front and rear helmet half sections, the locking assembly including means for orientating the lock assembly between a locked position and an unlocked position, wherein the locked position results in secured engagement of the at least one engagement region of the front and rear helmet half sections with each other, and the unlocked position facilitates slidable movement of the at least one engagement region of the front and rear helmet half sections and, in turn, the helmet half sections, relative to each other, and the locking assembly including a spring plate associated with an inner surface of the helmet rear half section, an outer attachment member associated with an outer surface of the helmet front half section, and an extension member releasably joining the spring plate and the outer attachment member, the orientating means facilitating controlled relative movement of the spring plate and the outer attachment member, to position the locking assembly in one of the locked and unlocked orientations.

12. The helmet according to claim 11 further comprising:

at least one elongated slot disposed on one of the helmet front half section and the helmet rear half section, at least one opening disposed on the other of the helmet front half section and the helmet rear half section, the at least one opening corresponding to the at least one elongated slot, wherein the extension member extending from the spring plate through the at least one opening and the at least one elongated slot to the outer attachment member.

13. The helmet according to claim 12 wherein the orientation means comprises a rotatable attachment of the outer attachment member relative to the spring plate, wherein such rotation of the outer attachment member relative to the spring plate facilitates the desired orientation of the locking assembly in one of a locked and an unlocked orientation.

14. The helmet according to claim 12 wherein the orientation means comprises a slidable attachment of the outer attachment member relative to the spring plate, wherein slidable movement of the outer attachment member relative to the spring plate facilitates a desired orientation of the locking assembly in one of a locked and an unlocked orientation.

15. The helmet according to claim 11 wherein the locking assembly includes means for retaining the desired selected orientation.

16. The helmet according to claim 15 when the retaining means comprises means for biasing the extension member against the outer attachment member, to, in turn, prevent undesired inadvertent movement thereof.

* * * * *